US009589741B2

(12) United States Patent
Wiese et al.

(10) Patent No.: US 9,589,741 B2
(45) Date of Patent: Mar. 7, 2017

(54) PRESSURE-ACTUATED SAFETY SWITCH WITH MONITORING FUNCTION

(71) Applicant: EATON ELECTRICAL IP GMBH & CO. KG, Schoenefeld (DE)

(72) Inventors: Artur Wiese, Bornheim (DE); Frank Bruchschmidt, Dausenau (DE)

(73) Assignee: EATON ELECTRICAL IP GMBH & CO. KG, Schoenefeld (DE)

( * ) Notice: Subject to any disclaimer, the term of this patent is extended or adjusted under 35 U.S.C. 154(b) by 0 days.

(21) Appl. No.: 14/898,774

(22) PCT Filed: Jun. 18, 2014

(86) PCT No.: PCT/EP2014/062805
§ 371 (c)(1),
(2) Date: Dec. 16, 2015

(87) PCT Pub. No.: WO2014/202654
PCT Pub. Date: Dec. 24, 2014

(65) Prior Publication Data

US 2016/0196933 A1 Jul. 7, 2016

(30) Foreign Application Priority Data

Jun. 20, 2013 (DE) ..... 10 2013 106 472

(51) Int. Cl.
*H01H 3/02* (2006.01)
*H01H 13/50* (2006.01)
(Continued)

(52) U.S. Cl.
CPC ..... *H01H 3/022* (2013.01); *H01H 13/50* (2013.01); *H01H 13/52* (2013.01); *H01H 13/62* (2013.01)

(58) Field of Classification Search
CPC .. H01H 3/02; H01H 9/00; H01H 9/24; H01H 13/14
(Continued)

(56) References Cited

U.S. PATENT DOCUMENTS

2002/0157935 A1 10/2002 Bonn et al.
2009/0200145 A1* 8/2009 Scherl ..... H01H 3/022 200/303

FOREIGN PATENT DOCUMENTS

DE 3523732 * 11/1986 ..... H01H 13/50
DE 4101493 A1 7/1992
(Continued)

*Primary Examiner* — Edwin A. Leon
*Assistant Examiner* — Iman Malakooti
(74) *Attorney, Agent, or Firm* — Leydig, Voit & Mayer, Ltd.

(57) ABSTRACT

A security switch has a switch head with an actuator and having a button top. The security switch is mounted in a housing wall. The actuator is designed so as to actuate contact elements of a switch module upon actuation into the switch position. The switch module is extended by a signaling switch block with contact elements located in the signaling flow path, wherein, in the assembly state of the security switch, the signaling switch block is subjected to an actuation pin that is rigidly arranged thereon. if the assembly state is undone or changed, the actuation pin disengages from the signaling switch block and signaling flow path opens. The actuation pin and signaling switch block are located outside the actuation region of the actuator of the security switch.

17 Claims, 3 Drawing Sheets

(51) Int. Cl.
*H01H 13/52* (2006.01)
*H01H 13/62* (2006.01)

(58) Field of Classification Search
USPC ..... 200/50.02, 341, 523
See application file for complete search history.

(56) References Cited

FOREIGN PATENT DOCUMENTS

| | | | |
|---|---|---|---|
| DE | 19960695 | A1 | 6/2001 |
| EP | 1906418 | A1 | 4/2008 |
| EP | 2299462 | A1 | 3/2011 |
| EP | 2525378 | A1 | 11/2012 |
| EP | 2600368 | A1 | 6/2013 |
| FR | 2582360 | A1 | 11/1986 |
| WO | WO 2011134766 | A1 | 11/2011 |

* cited by examiner

PRESSURE-ACTUATED SAFETY SWITCH WITH MONITORING FUNCTION

CROSS-REFERENCE TO RELATED APPLICATIONS

This application is a U.S. national stage application under 35 U.S.C. §371 of International Application No. PCT/EP2014/062805, filed on Jun. 18, 2014, and claims benefit to German Patent Application No. DE 10 2013 106 472.8, filed on Jun. 20, 2013. The International Application was published in German on Dec. 24, 2014, as WO 2014/202654 A1 under PCT Article 21(2).

FIELD

The invention relates to a safety switch having a monitoring function.

BACKGROUND

Safety switches of this type are known in many embodiments, also being referred to as control switches and/or signaling apparatuses. They are used in control panels, lifts, machines etc. for actuating electrical control systems. In potentially dangerous situations, actuating the safety switch causes the relevant circuits to open or close. Reference can be made to documents DE 199 60 695 A1 and DE 41 01 493 C2 as known examples.

A safety switch of this kind comprises a switch head having a plunger (as the actuation means) which is mounted in a housing wall in a receptacle opening. The longitudinal axis of the safety switch lies perpendicularly to the plane of the housing wall. The safety switch is mounted from the inner side of the housing wall using a threaded ring. The plunger of the safety switch is designed and installed such that upon actuation thereof (from the inoperative position) into the switch position, it acts upon contacts of a switch module by means of an actuation stroke. The essential function of the safety switch consists in the fact that, upon actuation (pushing in, pressing in), it influences the contacts of the switch module in such a way that an OFF switch function and/or a warning function occurs. The safety switch is most often used for an emergency off function, and therefore the safety switch is also referred to as an EMERGENCY OFF button. The actuation of the safety switch can be associated with a lock in the OFF switch position (in particular in an EMERGENCY OFF circuit).

EP 2525378 A1 discloses a safety switch, the housing of which is designed in such a way that it has a closure means which can be opened or removed only by means of unauthorized access (using mechanical force). Unauthorized access to the housing is therefore immediately recognizable.

In the case of pressure-actuatable safety switches there is the problem of incorrect assembly of the switch head and the switch module or unauthorized separation of the switch head and the switch module not being recognizable from the outside. Such a separation can occur by destruction of the assembly or by unauthorized access (tampering) to the assembly. The actuation of the switch head would not have any effect in such situations. The desired monitoring signal of the safety function is assumed to be absent.

EP 01906418 A1 discloses a safety switch having a monitoring function. In this safety switch too, upon actuation of the actuation means (plunger), contacts of a switch module are actuated (as known) by means of an actuation stroke, a switch block of the switch module being designed as a signaling switch block. When the safety switch is correctly mounted, the switch block which is designed as a signaling switch block is permanently actuated by means of an actuation pin. By means of this monitoring function which is achieved using the signaling switch block, a fault can be monitored in which the signaling switch block is detached from the housing wall using the actuation means mounted therein. The signaling switch block alters its switch state once it is more than a certain distance away from said housing wall, as a result of which a fault signal is emitted.

As mentioned, in the case of this safety switch one of the switch blocks is provided with a control function so that the switch block having the control function is excluded for other switch functions.

SUMMARY

An aspect of the invention provides a safety switch, comprising: an actuator including a button top, wherein the safety switch is mounted, using at least one fastener, in a housing wall in an mounting opening, in an assembled state having its longitudinal axis perpendicular to a plane of the housing wall, wherein the actuator of the safety switch is designed and installed such that, upon actuation into a switch position, one or more switch blocks of a switch module is actuated, wherein one of the switch blocks is designed as a signaling switch block, located in a signaling current path, wherein the signaling switch block is acted upon by an actuation pin in a correct assembled state of the safety switch, wherein when the signaling switch block is not in the correct assembled state, an actuation pin comes out of engagement with the signaling switch block, wherein the signaling switch block and the actuation pin are located outside the actuation range of the actuator.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
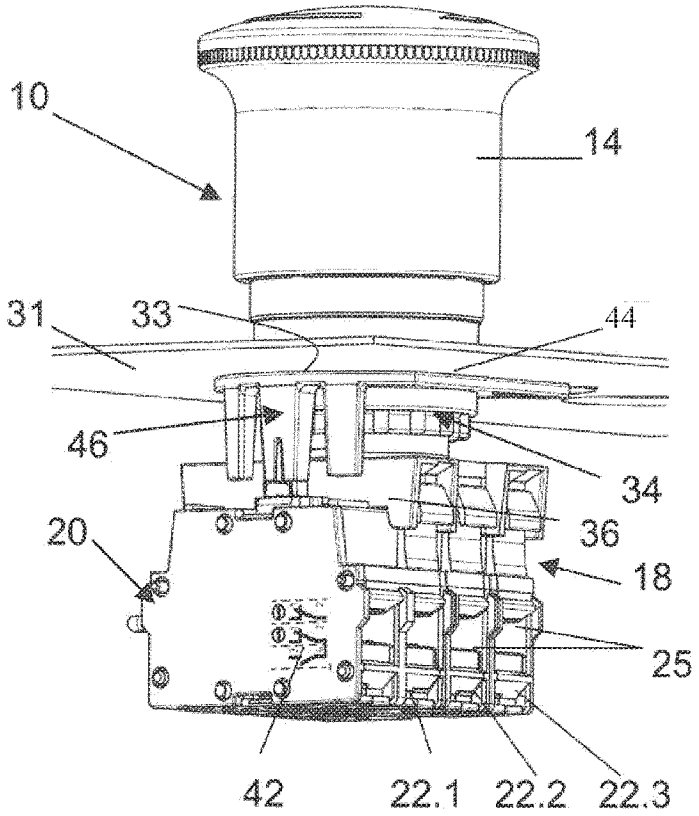
FIG. 1 shows a safety switch having a switch head, switch module and signaling switch block.

An aspect of the invention provides an arrangement of a safety switch in which a signaling switch block is formed which is provided for the sole purpose of a monitoring function.

An aspect of the invention lies in the fact that the switch module is extended by a signaling switch block which is provided with contact elements and is located in a signaling current path. A monitoring signal can be output if the safety switch and/or the housing thereof is accessed in an unauthorized manner and as a result the assembly of the switch head (actuation means) and the switch module is altered, or if incorrect assembly occurs.

The contact elements are acted upon in the assembled state of the safety switch by an actuation pin. The signaling switch block lies in a laterally offset manner next to the switch module comprising a plurality of switch blocks; in this case the signaling contact is associated with a (rigidly arranged) actuation pin. The actuation element of the signaling contact and the actuation pin are located outside the actuation range of the actuation means (plunger) of the safety switch.

When separating the switch head and the switch module (detaching the assembly) or in the case of incorrect assembly, the actuation pin has no effect on the signaling contact. The safety and monitoring function consists in the fact that when the signaling current path is open the notification or monitoring signal is emitted and/or a circuit is opened in which one or more safety-related machines are operated and the machines in operation are (automatically) switched off.

In the following, preferred features of the invention are given, these being able to be taken individually or in combination with one another (as appropriate).

The actuation pin can be formed on a pin-retaining panel which is retained and fastened on the mounting opening by the fastening means together with the switch head from the inner side of the housing wall, the actuation pin protruding perpendicularly from the pin-retaining panel and therefore lying in parallel with the axis of the safety switch.

The pin-retaining panel can be designed to have anti-rotation protection for the installation position on the mounting opening.

At least one actuation pin can be formed on an inner side of the housing wall, preferably formed integrally with the housing wall, the at least one actuation pin protruding perpendicularly from the housing wall. In the case of this preferred alternative according to the invention, the housing wall can be designed as a surface of a cover or as a surface of a housing cover.

An electrical circuit is located in the signaling current path, which circuit emits a warning signal and/or switches off safety-relevant electrical devices when the signaling current path is opened.

The actuation pin can be provided with an opening on the free front end, which opening is designed for inserting a spacer.

The opening can be designed as a insertion opening or as a threaded hole, the spacer being designed as a pin or as an adjusting screw.

The invention can be used in different installation situations of the safety switch. Two essential alternatives consist in the fact that the switch module is fastened to the switch head (head fastening) or that the switch module is fastened to the base panel (base fastening), which is opposite the housing wall.

In the head-fastening alternative, the switch module is retained by a mounting adapter, and therefore the switch module can be fixed to the fastening means. In the case of base fastening, there is no structural relationship between the switch module and the switch head. The switch head is at a spacing from the switch module, which spacing corresponds to the actuation stroke of the actuation means (plunger). In any case, in the case of base fastening and correct assembly, the signaling contact of the signaling switch block is acted upon by the actuation pin and therefore the signaling contact is in the closed position.

FIG. 1 shows the safety switch 10, which comprises a switch head 14 having actuation means. The figure shows the head-fastening alternative of a switch head. The plunger (actuation means 12) can be seen in FIG. 4 from the underside thereof.

In the head fastening shown, the mounting adapter 36 is clipped onto the switch head on the exit side of the plunger. The mounting adapter 36 is directed towards the contact side of the individual switch blocks of the switch module and joins the individual switch blocks 22.1, 22.2, 22.3 together. The individual switch blocks including the signaling switch block are inserted into the mounting adapter 36 and likewise clipped in. Therefore the switch module together with the signaling switch block is fixed to the switch head.

Figure 4:
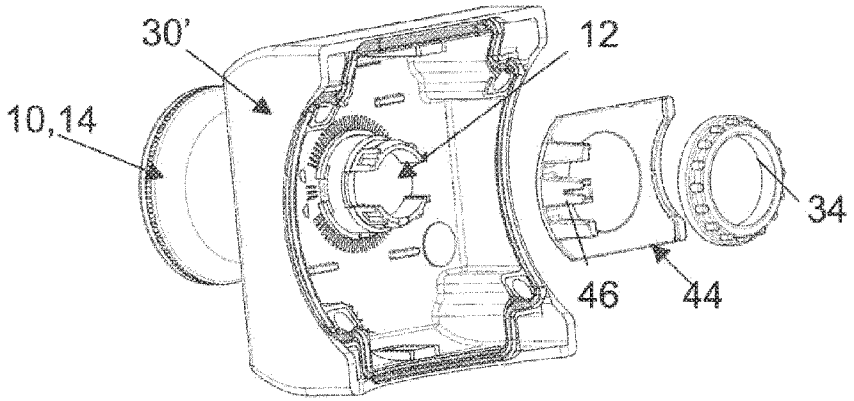
FIG. 4 shows a first cover (housing cover) having a pin-retaining panel and threaded ring.
Figure 5:
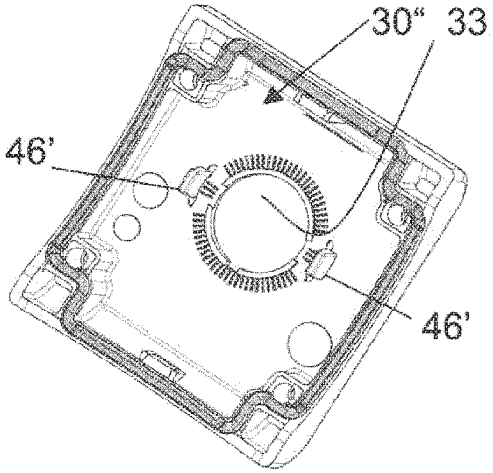
FIG. 5 shows a second cover (housing cover) having integrated actuation pins.

The switch head 14 is mounted in a round mounting opening 33 from the inner side of the housing wall 31 using a threaded ring 34. Mounting can also take place in the upper side, for example, of a cover-shaped housing (30', 30"). FIG. 4 and FIG. 5 show two alternatives of a cover-shaped housing.

The longitudinal axis of the safety switch lies perpendicularly to the plane of the housing wall 31 or perpendicularly to the upper side of the housing. The safety switch is designed and installed such that the plunger, upon actuation (from the inoperative position into the switch position), actuates the contact elements of the switch module 18. The essential function of the safety switch 10 consists in the fact that, upon actuation (pushing in, pressing in), it influences the contact elements of the switch module 18 in such a way that an OFF switch function and/or a warning function occurs. The safety switch is most often used for an emergency off function, and therefore the safety switch is also referred to as an EMERGENCY OFF button. The actuation of the safety switch can be associated with a lock in the switch position.

The present arrangement is, according to the invention, provided with a monitoring function. This function is effective if the switch module is separated from the safety switch, in particular if the switch head is separated from the switch module. The monitoring function should likewise be effective if individual switch blocks of the switch module are separated or incompletely installed. The separation can occur by destruction of the construction or by unauthorized access (tampering) or by incorrect assembly.

In FIG. 1, the switch module 18 comprises two individuals switch blocks (22.1, 22.2). The input terminals 25 of the individual switch blocks are at the front (visible) and the output terminals of the individual switch blocks are on the rear side and not visible. The switch module 18 is supplemented by a signaling switch block 20 in such a way that the signaling switch block is arranged in parallel with the individual switch blocks 22.1, 22.2 and has the same orientation as the individual switch blocks. The signaling switch block 20 lies in a laterally offset manner next to the individual switch blocks so that the signaling contact 42 is associated with the (rigidly arranged) actuation pin 46. The actuation element of the signaling contact is located outside the actuation range 100 of the plunger.

The rigid actuation pin 46 is located on a pin-retaining panel 44. The pin-retaining panel 44 is retained and fastened on the mounting opening by the threaded ring 34 together with the switch head from the inner side. The actuation pin 46 protrudes perpendicularly from the pin-retaining panel, which bears against the housing wall 31 (cover 30'). Therefore, the actuation pin 46 is in parallel with the axis of the plunger.

In the case of correct assembly of the switch module and the switch head, the actuation pin 46 acts upon the signaling contact of the signaling switch block 20 so that the signaling contact enters the closed position. In both the inoperative position and the switch position of the safety switch the signaling contact is closed, and the signaling current path is closed.

A preferred special embodiment as shown in FIG. 1 can consist in the fact that the signaling switch block 20 is designed as a double switch block. The double switch block has two spatially parallel contact elements which are bridged on the rear side of the double switch block. Therefore, the two contact elements of the double switch block (20, 22.1) are connected in series. The switch actuator of the signaling switch block 20 is on the upper side of the double switch block. The signaling switch block 20, which is on the left-hand side in FIG. 1, is acted upon by the actuation pin 46. The individual switch blocks, which are on the right-hand side in FIG. 1, are actuated by the plunger 12 of the switch head in the switch position. In the inoperative position of the switch head and in the case of correct assembly, the signaling contact is closed. The signaling contacts 42 of the signaling current path are visible schematically, having been printed on the signaling switch block 20.

Figure 2:
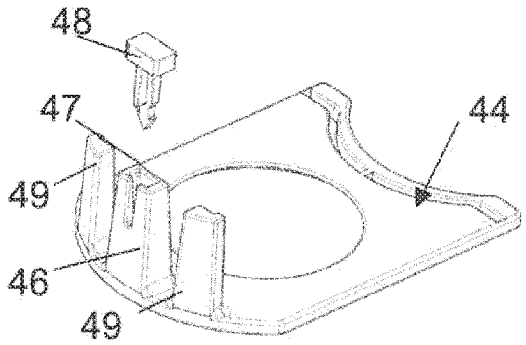
FIG. 2 shows a pin-retaining panel having a pin and a spacer.

FIG. 2 individually shows the pin-retaining panel 44 having an actuation pin 46.

Another alternative of an embodiment of at least one actuation pin 46' is described below with reference to FIG. 4.

In FIG. 2, the actuation pin 46 is also shown to have a spacer 48. The length of the actuation pin 46 is selected such that, in the assembled state, the signaling contact 42 is actuated. In a further preferred embodiment, the actuation pin can be provided with an opening on the free front end. The opening 47 can be designed as an insertion opening or as a threaded hole, into which a spacer 48 can be inserted. The spacer can be designed as either a pin 48 or an adjusting screw. The spacer 48 can be used to adapt the length of the actuation pin 46, so that different distances from the switch head and from the signaling contact block can be bridged depending on the variants of the assembly. Different distances are present if the safety switch is installed in housings which have housing walls (31) of different thicknesses. Two limit pegs 49 are provided on the pin-retaining panel 44 in parallel with the actuation pin 46, as a result of which the position of the mounting adapter 36 (described below) can be set easily.

Figure 3:
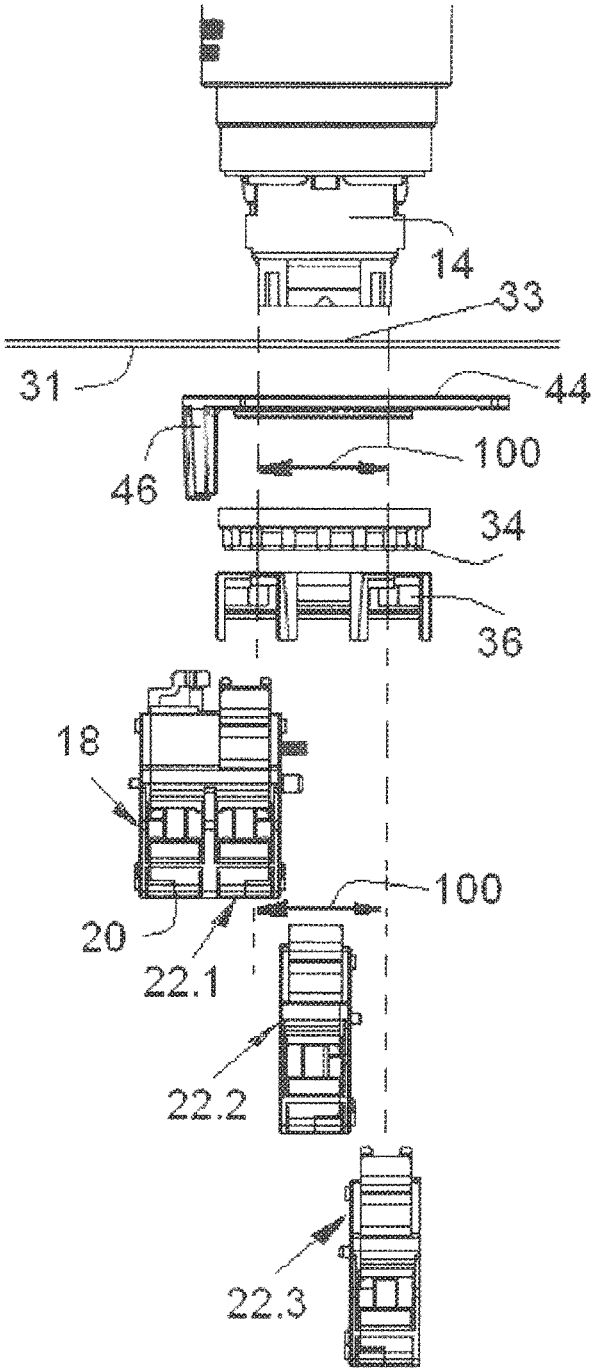
FIG. 3 is an exploded front view of the safety switch.

FIG. 3 shows an exploded front view of the safety switch having a switch head, switch module and signaling switch block. As in FIG. 1, the same reference numerals can be seen: switch head 14 in the head-fastening alternative; housing wall 31; pin-retaining panel 44 having an actuation pin 46; threaded ring 34; mounting adapter 36; individual switch blocks 22.1, 22.2, 22.3; signaling switch block 20.

The actuation range 100 of the plunger of the safety switch is in particular emphasized. The plunger actuates only the contact elements of the switch module 18 or the contact elements of the individual switch blocks 22.1, 22.2 and 22.3.

The signaling switch block 20 (and its signaling contacts 42) are located laterally outside the actuation range 100 and are associated with the (rigidly arranged) actuation pin 46.

What is not shown is a preferred special embodiment which can consist in the fact that the switch module is constructed only from individual switch blocks. That is to say that the signaling switch block is also incorporated as an individual switch block in a correspondingly enlarged mounting adapter 36.

If the switch module is separated from the safety switch, the actuation pin 46 comes out of engagement with the signaling contact of the signaling switch block. The signaling current path is opened, and therefore a warning or notification signal can be emitted thereby. In the switch position of the switch head and in the case of correct assembly, the second switch actuator of the signaling switch block is actuated together with the individual switch blocks. In the electrical circuit which is associated with the safety switch, the signaling current path, which is open in this case, can be "ignored" since the actuation of the safety switch itself causes the safety function to be triggered.

FIG. 4 shows a first cover 30' (housing cover) in which a switch head 14 is inserted into the mounting opening. FIG. 4 shows the situation in exploded view in conjunction with the pin-retaining panel 44.

FIG. 5 shows a second cover 30" (housing cover) for receiving the switch head 14. This figure also shows the mounting opening 33 in the cover 30". On the inner side of the cover 30", two rigid actuation pins 46' are integrally formed with the cover. This is a variant having two actuation pins 46'. The actuation pins are formed so as to be opposite on the mounting opening 33. It makes no difference which position the cover 30" assumes when assembled with respect to a switch module. In every position of the cover, one of the actuation pins assumes the correct position in relation to the signaling switch block. In contrast with the embodiment of the pin-retaining panel 44 in FIG. 2, no further individual part on which an actuation pin is formed is required. The actuation pins 46' in the cover 30" can likewise be designed to have openings (47) and to have spacers (48) as in FIG. 2.

The invention can be summarized as follows:

A safety switch is proposed which has a switch head (comprising actuation means and a button top), the safety switch being mounted, using fastening means (threaded ring), in a housing wall in a mounting opening. The actuation means (plunger) is designed and installed such that, upon actuation into the switch position, it actuates contact elements of a switch module 18. A known problem in the case of safety switches is that incorrect assembly of the switch head and the switch module or unauthorised separation of the switch head and the switch module is not recognisable from the outside and the desired safety shutdown function does not occur. It is therefore provided that the switch module 18 is extended by a signaling switch block 20 which contains contact elements located in a signaling current path, the signaling switch block being acted upon by an actuation pin 46 that is rigidly arranged with respect thereto in the assembled state of the safety switch, and therefore when it is not in the assembled state or the assembled state is changed, the actuation pin comes out of engagement with the signaling switch block 20 and opens the signaling current path. The actuation element of the signaling contact and the signaling switch block are located outside the actuation range of the actuation means (plunger) of the safety switch.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

REFERENCE NUMERALS

10 pressure-actuatable safety switch
12 plunger (FIG. 4)
14 switch head (button)
18 switch module comprising at least one individual switch block
20 signaling switch block
22.1, 22.2, 22.3 individual switch blocks
25 input terminal (output terminal)
30', 30" two covers
31 housing wall
33 mounting opening in 30', 31
34 fastening means (threaded ring)
36 mounting adapter
42 monitoring contacts or signaling contacts
44 pin-retaining panel
46, 46' actuation pins
47 opening (insertion opening or threaded hole)
48 spacer as a pin or adjusting screw
49 limit peg

The invention claimed is:

1. A safety switch, comprising:
an actuator including a button top,
wherein the safety switch is mounted, using at least one fastener, in a housing wall in a mounting opening, in an assembled state having a longitudinal axis perpendicular to a plane of the housing wall,
wherein the actuator of the safety switch is designed and installed such that, upon actuation into a switch position, one or more switch blocks of a switch module is actuated,
wherein one of the switch blocks is designed as a signaling switch block, located in a signaling current path,
wherein the signaling switch block is acted upon by an actuation pin in a correct assembled state of the safety switch,
wherein when the signaling switch block is not in the correct assembled state, an actuation pin conies out of engagement with the signaling switch block, and
wherein the signaling switch block and the actuation pin are located outside an actuation range of the actuator in a lateral direction perpendicular to the longitudinal axis.

2. The switch of claim 1, wherein the actuation pin is formed on a pin-retaining panel,
wherein the pin-retaining panel is retained and fastened on the mounting opening by the fastener together with the button top from an inner side of the housing wall,
wherein the actuation pin protrudes perpendicularly from the pin-retaining panel.

3. The switch of claim 2, wherein the pin-retaining panel is designed to have anti-rotation protection for an installation position on the mounting opening.

4. The switch of claim 1, wherein at least one further actuation pin is formed on an inner side of the housing wall and the further actuation pin protrudes perpendicularly from the housing wall.

5. The switch of claim 4, wherein two further actuation pins are formed so as to he opposite on an inner side of the housing wall and on the mounting opening.

6. The switch of claim 1, wherein an electrical circuit is located in the signaling current path,
wherein the electrical circuit emits a warning signal and/or switches of safety-relevant electrical devices when the signaling current path is opened.

7. The switch of claim 1, wherein the actuation pin and/or a further actuation pin includes an opening on a free front end, the opening being designed for inserting a spacer.

8. The switch of claim 7, wherein the opening is an insertion opening or as a threaded hole, and
wherein the spacer is a pin or as an adjusting screw.

9. The switch of claim 1, wherein the switch module is retained by a mounting adapter, so as to fix the switch module to the fastener.

10. The switch of claim 6, wherein the electrical circuit emits the warning signal when the signaling current path is opened.

11. The switch of claim 6, wherein the electrical circuit switches off one or more safety-relevant electrical devices when the signaling current path is opened.

12. The switch of claim 7, wherein the opening is an insertion opening.

13. The switch of claim 7, wherein the spacer is a pin.

14. The switch of claim 7, wherein the spacer is an adjusting screw.

15. The switch of claim 7, wherein the opening is a threaded hole.

16. A safety switch, comprising:
an actuator including a button top,
wherein the safety switch is mounted, using at least one fastener, in a housing wall in a mounting opening, in an assembled state having its longitudinal axis perpendicular to a plane of the housing wall,
wherein the actuator of the safety switch is designed and installed such that, upon actuation into a switch position, one or more switch blocks of a switch module is actuated,
wherein one of the switch blocks is designed as a signaling switch block, located in a signaling current path,
wherein the signaling switch block is acted upon by an actuation pin in a correct assembled state of the safety switch,
wherein when th.e signaling switch block is not in the correct assembled state, an actuation pin comes out of engagement with the signaling switch block,
wherein the signaling switch block and the actuation pin are located outside an actuation range of the actuator, and wherein at least one further actuation pin is formed on an inner side of the housing wall and the further actuation pin protrudes perpendicularly from the housing wall.

17. A safety switch, comprising:

an actuator including a button top, wherein the safety switch is mounted, using at least one fastener, in a housing wall in a mounting opening, in an assembled state having its longitudinal axis perpendicular to a plane of the housing wall, wherein the actuator of the safety switch is designed and installed such that, upon actuation into a switch position, one or more switch blocks of a switch module is actuated, wherein one of the switch blocks is designed as a signaling switch block, located in a signaling current path, wherein the signaling switch block is acted upon by an actuation pin in a correct assembled state of the safety switch, wherein when the signaling switch block is not in the correct assembled state, an actuation pin comes out of engagement with the signaling switch block, wherein the signaling switch block and the actuation pin are located outside an actuation range of the actuator, wherein the actuation pin and/or a further actuation pin includes an opening on a free front end, the opening being designed for inserting a spacer.

* * * * *